United States Patent [19]

Fisher

[11] Patent Number: 4,496,027

[45] Date of Patent: Jan. 29, 1985

[54] MOBILE OUTRIGGER FOR SUSPENDING SCAFFOLD

[75] Inventor: Harry S. Fisher, Renton, Wash.

[73] Assignee: Spider Staging, Inc., Renton, Wash.

[21] Appl. No.: 462,303

[22] Filed: Jan. 31, 1983

[51] Int. Cl.[3] ..... E04G 3/10

[52] U.S. Cl. ..... 182/142; 182/150; 248/237

[58] Field of Search ..... 182/142–147, 182/15, 150, 36, 37, 45, 82; 248/237; 187/6

[56] References Cited

U.S. PATENT DOCUMENTS

| | | | |
|---|---|---|---|
| 1,616,769 | 2/1927 | Todd et al. . | |
| 2,430,179 | 11/1947 | Lanchester | 304/29 |
| 2,604,359 | 7/1952 | Zybach | 299/54 |
| 2,775,488 | 12/1956 | Wingrove | 304/9 |
| 3,007,540 | 11/1961 | Reinhardt | 182/142 |
| 3,130,813 | 4/1964 | Fackler et al. | 182/36 |
| 3,537,545 | 11/1970 | Willis | 182/14 |
| 3,854,550 | 12/1974 | Shingler | 182/36 |
| 3,957,204 | 5/1976 | Farris et al. | 239/177 |
| 4,096,922 | 6/1978 | Fisher | 182/36 |
| 4,142,548 | 3/1979 | Orcutt | 137/344 |
| 4,274,507 | 6/1981 | Williams | 182/142 |

FOREIGN PATENT DOCUMENTS

| | | | |
|---|---|---|---|
| 645151 | 10/1950 | United Kingdom | 182/15 |

*Primary Examiner*—Reinaldo P. Machado
*Attorney, Agent, or Firm*—Delbert J. Barnard

[57] ABSTRACT

A portable motor outrigger for suspending scaffolding in which there are a pair of spaced generally parallel, substantially A-frame-shaped supports (30, 32), having a beam (26) extending therebetween. Each A-frame has two plates (100, 108), one adjacent the lower end of one leg (76) and the other adjacent the lower end of the other leg (78). The plates are adapted to be positioned on a surface (12) to support the beam (26) through the A-frame supports. A wheel (104) is mounted for rotation in a lower part of the A-frame and is positioned to be substantially in vertical alignment with the center of gravity of the weight on the support. A caster (98) depends from an end (86) of each A-frame, the wheel and caster being above a roof surface when the plates (100, 108) support the A-frames on the roof surface. A jackscrew (92) is mounted on one end of each A-frame adjacent the caster and is adapted to raise and lower plate (100) adjacent the caster with respect to the A-frame and the caster. When the jackscrew is rotated to move the plate on its end toward the A-frame, the wheel and caster are lowered toward the roof surface. When the caster touches the roof surface and the plate (100) is lifted from the roof surface, the A-frame tilts so that the plate (108) is raised and so that the A-frames with the caster and wheel on the roof surface can be moved by exerting a horizontal force on the beam and can be rotated around a building corner by exerting horizontal forces on the beam at the end of adjacent the corner.

The method for positioning a mobile scaffold suspending outrigger for horizontal movement, including rotation by a single person.

33 Claims, 6 Drawing Figures

MOBILE OUTRIGGER FOR SUSPENDING SCAFFOLD

TECHNICAL FIELD

The invention relates to a mobile outrigger for use in suspending a staging or scaffold, and in particular to an approved mobile outrigger that can be easily moved and rotated by a single person rotation.

BACKGROUND ART

Mobile outriggers for scaffolds in the prior art have been relatively heavy, complicated, and difficult to maneuver, particularly around building corners where the rotation operation typically requires the efforts of at least two persons.

A search of the patent literature discloses a number of mobile or portable outriggers and other mobile devices. For example, U.S. Pat. No. 3,854,550 illustrates a mobile outrigger for scaffolds. The outrigger is in the form of a pair of transversely spaced trucks. Each truck is wheeled on casters and permits movement of the scaffolds laterally and vertically as well as toward or away from the building. The outrigger system constitutes very heavy equipment and is such that the beams on each of the outriggers can be telescoped out away from the building far enough so that the scaffolding can be maneuvered around a building corner.

U.S. Pat. No. 4,096,922 discloses an outrigger system in which leg supports depend from a beam and make contact with the roof. At a location inwardly of the leg supports, the outrigger beam is secured to an elevated support rail in a manner to permit both axial, sideways, and angular movement for proper positioning of the outboard end of the beam relative to the side of a building.

U.S. Pat. No. 4,274,507 shows a portable support for a scaffold comprised of first and second wheeled support members. An electric motor is provided on one of the support members to drive the first and second support members as a unit along a building roof.

The following list includes the additional patents found in the search:

U.S. Pat. No. 1,616,769
U.S. Pat. No. 2,430,179
U.S. Pat. No. 2,604,359
U.S. Pat. No. 2,775,488
U.S. Pat. No. 3,130,813
U.S. Pat. No. 3,537,545
U.S. Pat. No. 3,957,204
U.S. Pat. No. 4,142,548

DISCLOSURE OF THE INVENTION

The invention is a portable mobile outrigger for use with a scaffold and suspension means therefor, and a method for positioning the outrigger for horizontal movement including rotation. The outrigger includes a pair of spaced generally parallel, substantially A-frame-shaped supports having a beam extending between the supports and engaged therewith, the beam being removably secured adjacent the respective apexes of the A-frames. Each of the A-frames has two feet on which it is supported during operation on a roof surface. One foot is secured adjacent a lower end of one leg of the A-frame and the other foot is secured adjacent a lower end of the other A-frame leg.

Each of the A-frame supports has a relatively large wheel positioned on the support to be in substantial vertical alignment with the center of gravity of the weight on the support. A caster extends downwardly from the support adjacent the other foot, secured adjacent a lower end of the other A-frame leg. The wheel and caster are not in contact with the roof surface when the support is resting on the feet. The wheel has a wide tread tire so as to not damage the roof surface when it is in position to support a respective A-frame on the roof.

A jackscrew is secured to each of the respective A-frames adjacent the other end and has the other foot attached to the lower end of the screw so that rotation of the screw raises or lowers the other foot with respect to the respective A-frame. The one foot is pivotally mounted on the respective one lower end of each A-frame.

When both of the feet are on the roof surface, each jackscrew is adapted to lower a wheel and a caster toward the surface. When the other foot, adjacent the jackscrew and the caster, is raised relative to the A-frame so as to lower the caster and the wheel onto the roof surface, the one foot at the other end of the A-frame is moved vertically off the surface. The movement of the one foot occurs after the wheel and just before or after the caster makes contact with the surface so that the A-frame tilts to raise the one end opposite the caster.

There is a generally horizontal frame member or port on each A-frame, the horizontal frame member extending between the A-legs forming the A-frame support. Each frame member is secured to the respective A-legs adjacent their lower ends. A respective wheel is secured for rotation on a respective frame member between the A-legs, and the jackscrew is supported on each of the A-frames, on a respective frame member adjacent the other ends of the A-frame.

The operation of the portable mobile scaffold suspending outrigger for horizontal movement including rotation first includes lowering two corresponding first ends of the A-frame outrigger beam supports, the first ends being lowered until casters on the beam supports make supporting contact on a supporting roof surface, a caster being adjacent each of the first ends. Each first end is lowered by raising a support plate adjacent a caster and in supporting contact with the roof supporting surface until the caster makes supporting contact. A wheel on each of the beam supports is lowered while a respective first end is lowered, the wheel being lowered until it makes supporting contact on the supporting roof surface. Second ends of the respective beam supports are raised from supporting contact on the roof surface when respective casters and wheels are in supporting contact on the roof surface and the feet have been raised from supporting contact.

Thus, the invention provides a portable outrigger which can be operated and performed, respectively, by a single person. When the feet are raised off the surface and the supports have the wheels in contact with the roof surface, the outrigger can be moved along the roof surface by one person exerting generally horizontal forces on the beam, most effectively adjacent its center. For rotating the outrigger around corners, the operator can best move the outrigger by engaging the beam at the end adjacent the corner and push the beam so that the one end rotates the outrigger at the corner, and the other end follows. The foregoing movement is accomplished without a scaffold being supported by the outrigger.

When the scaffold is attached to the outer ends of the outrigger beams, counterweights are positioned on each beam inwardly of the A-frame remote from the side of the building. This prevents the individual outriggers from overturning and from bowing upwardly, as would tend to occur if the counterweights were positioned outwardly of the A-frame at the remote end of the beam.

Further advantages of the invention may be brought out in the following part of the specification wherein small details have been described for the competence of the disclosure, without intending to limit the scope of the invention which is set forth in the appended claims.

BRIEF DESCRIPTION OF THE DRAWINGS

Referring to the accompanying drawings which are for illustrative purposes.

BEST MODE FOR CARRYING OUT THE INVENTION

Figure 1:
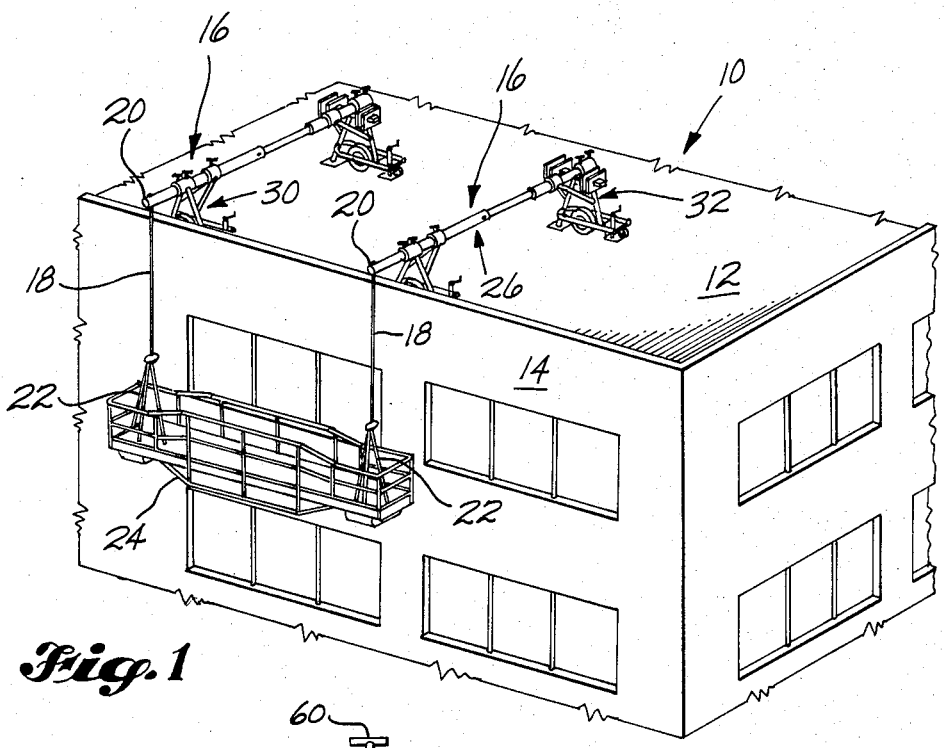
FIG. 1 is a pictorial view of a pair of outriggers, according to the invention, supported on the roof of a building and having scaffolding supported on their ends; the scaffolding extending along the side of the building.
Figure 2:
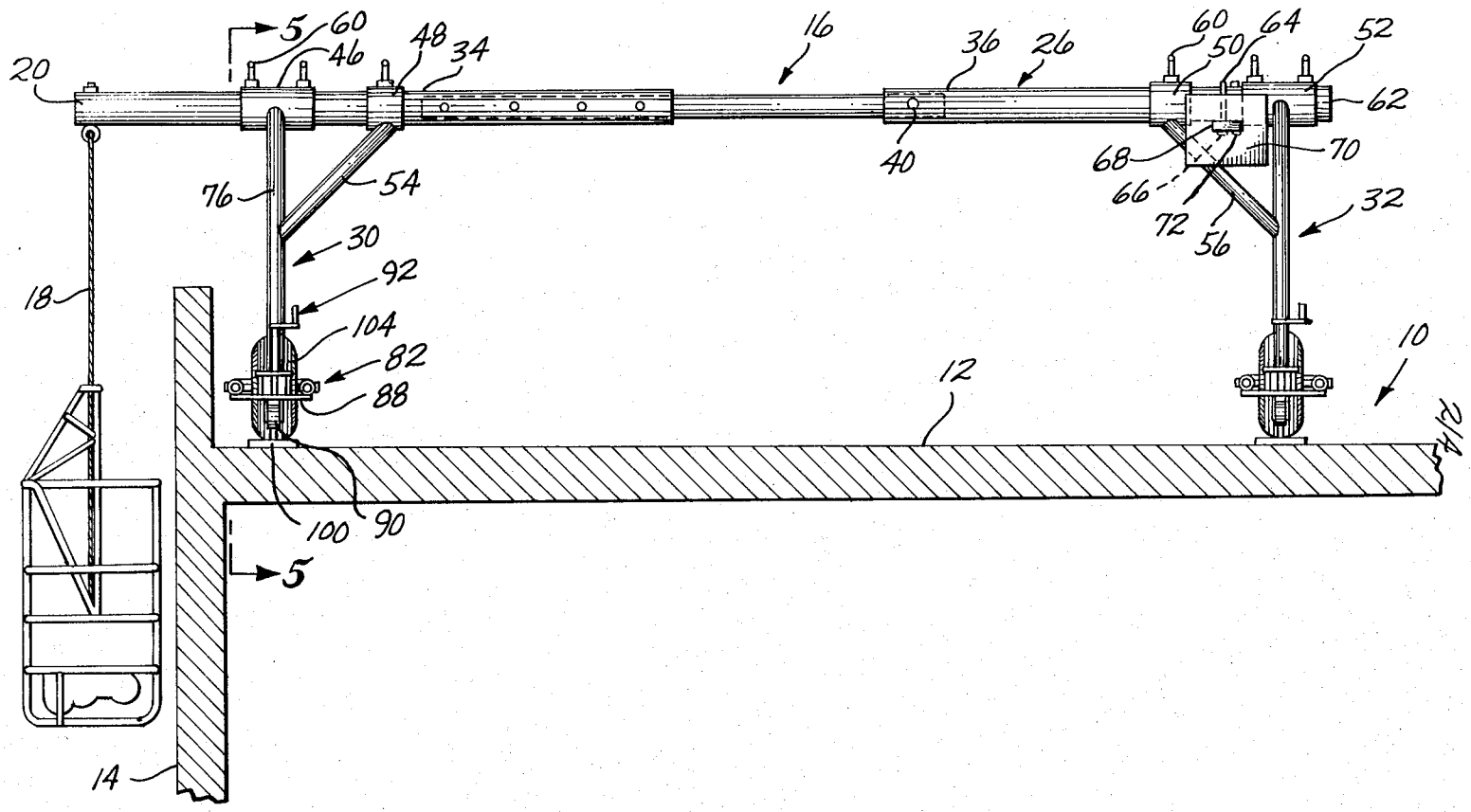
FIG. 2 is an end elevational view of one of the outriggers and the scaffolding shown in FIG. 1.
Figure 3:
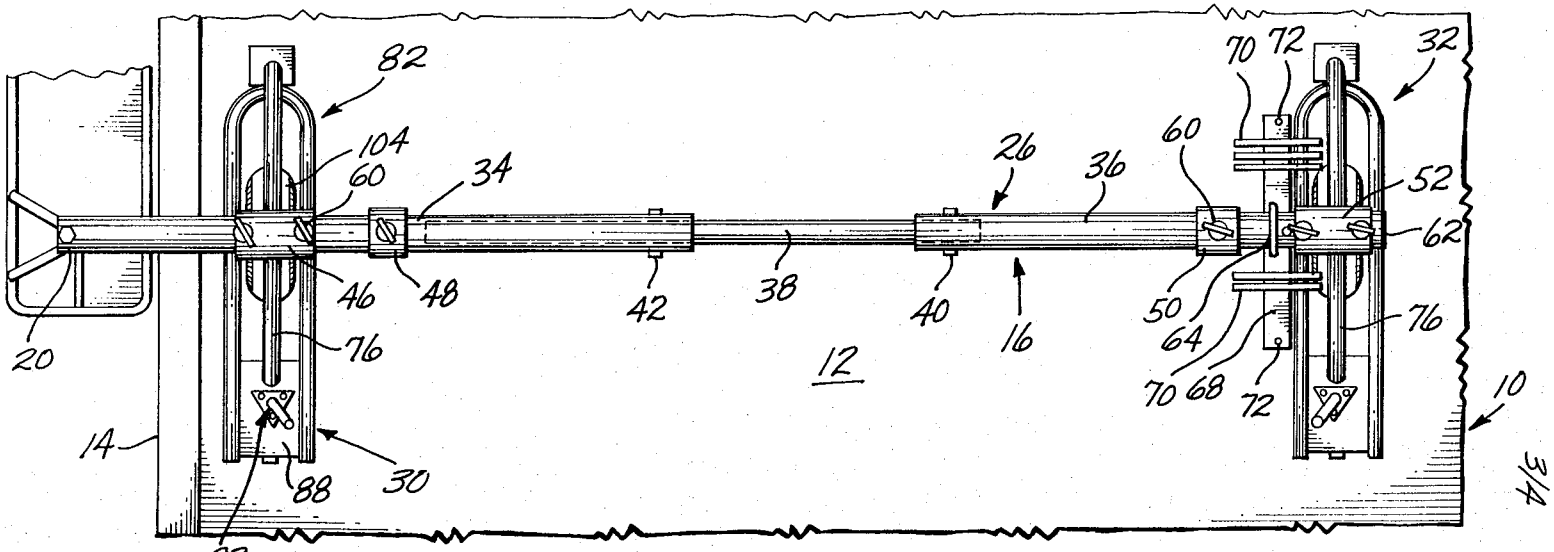
FIG. 3 is a plan view of one of the outriggers shown in FIG. 1.

Referring again to the drawings, in FIGS. 1–3, there is shown a building 10, having a roof surface 12 and a sidewall 14. Supported on the roof are a pair of staging supports or outriggers 16, each having a staging or scaffolding suspension line 18, secured at its upper end to the outer end 20 of the outriggers. At the lower ends of the lines 18 there are cable drums (not shown) 22, each carried by a staging unit that is secured to one end of a scaffold 24, supported for work along the wall 14 of the building.

Figure 5:
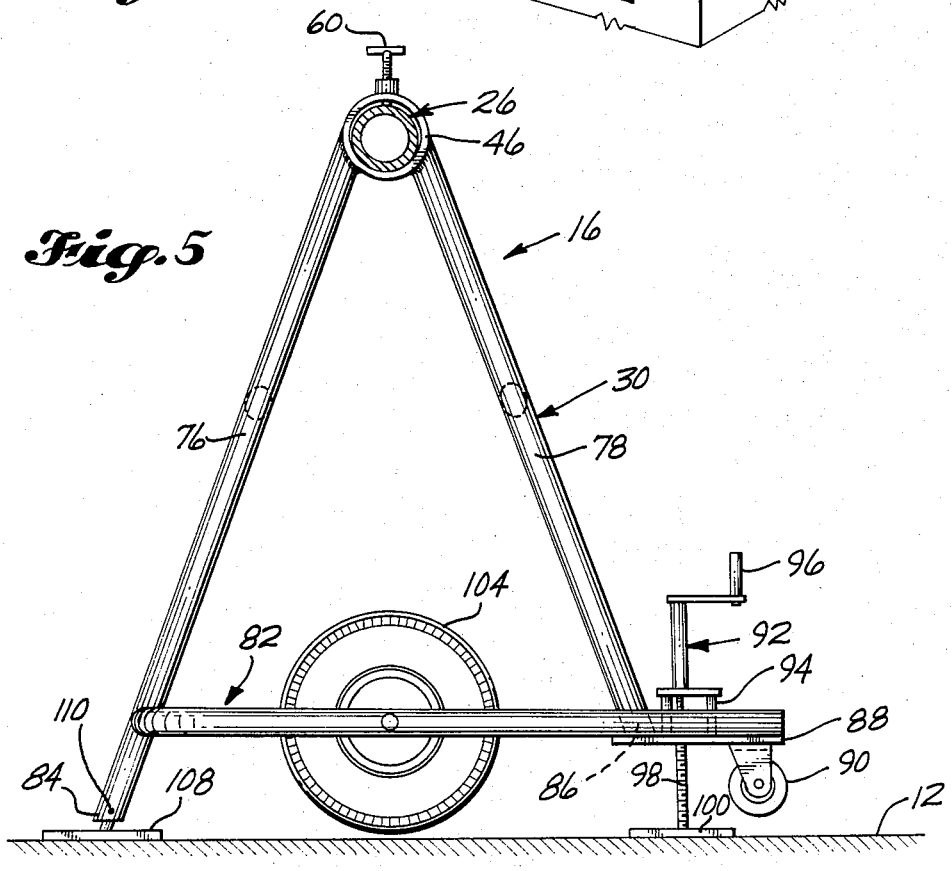
FIG. 5 is an end view of an A-frame support, taken along the lines 5—5 in FIG. 2.
Figure 4:
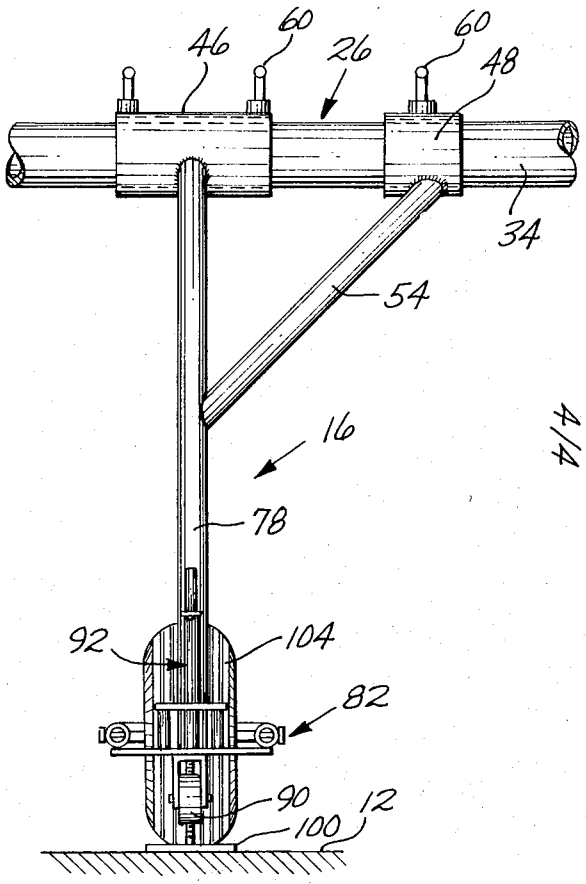
FIG. 4 is an enlarged fragmentary end view of a portion of an outer end of the outrigger and a support shown in FIG. 2.
Figure 6:
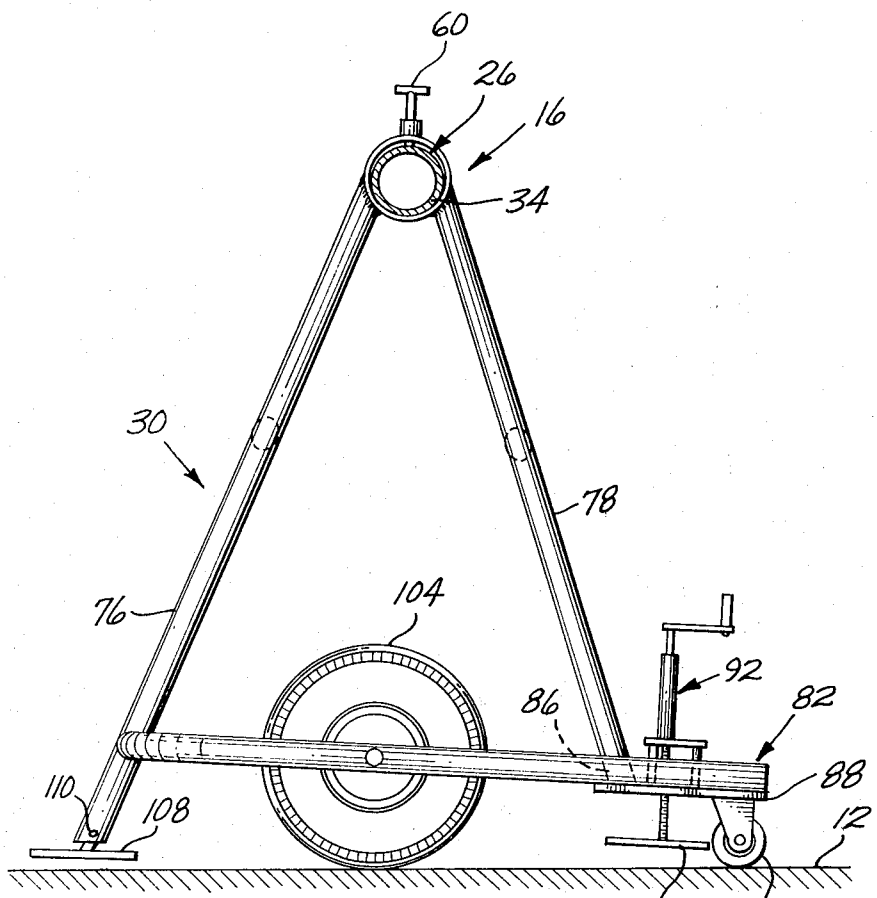
FIG. 6 is a view of the A-frame, shown in FIG. 5, the A-frame being supported on a wheel and caster in position for movement on a roof surface.

Each of the outriggers has a generally horizontal beam 26, supported by a pair of spaced, generally parallel A-frames 30 and 32, FIGS. 5 and 6. The beam 26 is shown to be cylindrical but may also be rectangular, for example. It is comprised of two tubes 34 and 36 connected by a telescoping rod 38, removably secured at 40 and 42 to permit elongating adjustment of the beam. The tubular members of the beam are slidably engaged in tubular sleeves 46, 48, 50 and 52. The supporting sleeves 46 and 52 are secured at the apex of the respective A-frames and the sleeves 48 and 50 are supported on pairs of struts 54 and 56; secured to respective A-frame legs 76 and 78, as shown in FIGS. 2, 4, and 5, on the A-frame 30. The beam is removably secured in the four supporting sleeves by means of T-bolts 60.

As shown in FIGS. 1–3, adjacent inner end 62 of the beam but outwardly of the A-frame 32, relative to the building wall 14, is an inverted U-shaped member 62 having bolts 66 at its lower ends so as to support a transverse generally horizontal, rectangular counterweight support member 68. Counterweights 70 are slidably engaged on the support 68 by means of a rectangular opening complementary to the cross section of the support. The weights are secured in place by vertically extending pins 72 adjacent the ends of the support. Counterweights and the moment arm of the beam between them and the end 20 provide a four-to-one safety factor against overturning at the end 20. The counterweights 70 are positioned outwardly of the A-frame 32 rather than inwardly thereof to prevent overturning at the inward end and also to prevent upward bowing of the beam between the A-frames.

The A-frame 30, identical to the A-frame 32 but in reverse position, is shown in FIGS. 4–6. Extending downwardly from the support sleeve 46 are two A-frame legs 76 and 78. A generally horizontal U-shaped frame member 82 is secured to A-leg 76 above its lower end 84 and is secured to A-leg 78 at a raised lower end 86 by means of a plate 88, secured to the underside of the U-shaped member adjacent its open end. Secured to the plate 88 and extending downwardly therefrom is a caster 90. A jackscrew 92 is secured to the upper side of the plate 88 by means of an inverted U-shaped member 94. The jackscrew has a rotatable handle 96, and at the lower end extending through the plate, a screw 98 is secured to a roof surface contacting support foot, in the form of a plate 100, the jackscrew being adapted to raise and lower the plate 100 with respect to the A-frame end 86 and the caster 90.

Rotatably mounted in the U-shaped frame member 82 is a wheel 104, substantially larger than the caster and having a rubber tire with wide treads to protect the roof surface 12. The wheel 104 is centrally mounted geometrically with respect to the A-frame so as to be vertically aligned with the center of gravity of the weight placed upon the A-frame through the beam 26. A second support foot, also in the form of a plate 108 is pivotally connected at 110 to the lower end 84 of the A-leg 76.

As shown in FIGS. 1–5, the plates 100 and 108 on each of the A-frames are resting upon the roof surface 12 to hold the two outriggers and is suspended scaffold in a fixed horizontal position. When it is required to move the scaffold 24 horizontally, it is lowered and detached from the outriggers. To move the outriggers to support the scaffold in the desired horizontal position, the end of the leg 78 and the caster 90 are lowered, as indicated in FIG. 6, by raising the plate 100 by the jackscrew 92. Each jackscrew on the two outriggers is operated separately.

In comparing FIGS. 5 and 6, it is seen that as the plate 100 is raised relative to the plate 88, the wheel 104 and the caster 90 are lowered, the wheel 104 making contact with the surface 12 before the caster because it is more closely spaced to the surface 12, as shown in FIG. 5. As the plate 100 is continued to be raised by the jackscrew, it is moved above the level of the lower surface of the caster and the caster makes supporting contact on the surface 12. Because the wheel 104 is positioned vertically with respect to the center of gravity of the weight on the beam and because of additional weight from the positioning of jackscrew and its supporting structure, and the caster being more remote from the center of the A-frame than the plate 108, when the plate 100 is raised to a position so that the caster makes contact, the A-frame tilts to raise the plate 108 off of the surface 12, if the tilting has not occurred before the plate 100 is removed from supporting contact.

When the two A-frames supporting one beam of an outrigger are in the position shown in FIG. 6, an outrigger 16 can be moved horizontally on the roof by one person, by applying horizontal force adjacent the center of the beam 26. In order to move an outrigger around a corner, a single person by applying horizontal forces to the beam adjacent the outer end 20, can rotate the beam and two A-frames without any difficulty with the aid of the vertically rotatable caster. As the rotation occurs around a corner, some maneuverability is required and one person can push the end 20 and at the same time move the beam and inward A-frame in the desired path of rotation. When the horizontal positioning of the two beams is achieved, the scaffold 24 is again attached to the supporting lines 18 for vertical operation with respect to the building.

The invention and its attendant advantages will be understood from the foregoing description and it will be apparent that various changes may be made in the form, construction, and arrangements of the parts of the invention without departng from the spirit and scope thereof or sacrificing its material advantages, the arrangements hereinbefore described being merely by way of example. I do not wish to be restricted to the specific forms shown or uses mentioned except as defined in the accompanying claims.

What is claimed is:

1. An end support for an elongated outrigger beam which during use is supported on a building roof or the like, by a pair of such supports, spaced apart longitudinally of the beam and supporting such beam with an outboard end portion thereof extending outwardly from the side of the building, to provide an upper end support for a suspended staging, said end support comprising:

a frame having an upper portion connectable to the beam, and first and second support feet spaced apart from each other, laterally of the beam, with the first support foot being located on one side of the beam and the second support foot being located on the opposite side of the beam;

a wheel mounted on said frame between the support feet, for rotation about an axis which is parallel to the beam;

means for adjusting the relative vertical positions of the first and second support feet and a lower support surface contacting portion of the wheel, between a first position in which the first and second support feet are both on the support surface and the wheel is elevated above the support surface, and the system is fixed in position on the support surface, and a second position in which the wheel is down on the support surface and both support feet are spaced above the support surface, and the system is mobile on the wheel, said means for adjusting comprising means for moving the second foot in position vertically relative to said frame, between a lower position in which said first and second support feet are both on the roof or other support surface and the wheel is elevated above the support surface, and an upper position in which the wheel is down on the support surface and both support feet are spaced above the support surface; and a small caster mounted on said frame proximate the second foot, said caster being positioned to be elevated above the support surface contacting portion of the wheel when the second support foot is in said lower position and to be in contact with the support surface when the said second support foot is in its said upper position, so that when the second support foot is in its said upper position, the end support is supported for movement by said wheel and said caster.

2. An end support according to claim 1, wherein the means for adjusting comprises screw jack means interconnected between the frame and said second foot, including rotatable handle means rotatable in a first direction for moving the frame upwardly relative to the second foot and in the opposite direction for moving the frame downwardly in relation to the second foot.

3. An end support according to claim 1, wherein said wheel is positioned on said frame to be in substantial vertical alignment with the center of gravity of the weight on said end support.

4. An end support according to claim 1, in which said end support frame is generally in the shape of an A-frame, having an upper end apex portion connectable to the beam, a pair of downwardly diverging, first and second side members connectable at their upper ends to the apex portion, and a cross frame part interconnected between lower portions of said side members.

5. An end support for an elongated outrigger beam which during use is supported on a building roof or the like, by a pair of such supports, spaced apart longitudinally of the beam and supporting such beam with an outboard end portion thereof extending outwardly from the side of the building, to provide an upper end support for a suspended staging, said end support comprising:

a frame having an upper portion connectable to the beam, and first and second support feet spaced apart from each other, laterally of the beam, with the first support foot being located on one side of the beam and the second support foot being located on the opposite side of the beam;

a wheel mounted on said frame between the support feet, for rotation about an axis which is parallel to the beam;

means for adjusting the relative vertical positions of the first and second support feet and a lower support contacting portion of the wheel, between a first position in which the first and second support feet are both on the support surface and the wheel is elevated above the support surface, and the system is fixed in position on the support surface, and a second position in which the wheel is down on the support surface and both support feet are spaced above the support surface, and the system is mobile on the wheel, wherein said end support frame is generally in the shape of an A-frame, having an upper end apex portion connectable to the beam, a pair of downwardly diverging, first and second side members connectable at their upper ends to the apex portion, and a cross frame part interconnected between lower portions of said side members; and wherein said cross frame part includes a first end portion connected to the first side member, at a location spaced above the first support foot, and a second end portion connectable to the second side member at a location spaced above the second support foot, wherein the first side member extends downwardly from its location of connection with the cross frame part and terminates at a lower end, and wherein said first support foot is connected to said lower end.

6. An end support according to claim 5, wherein the second end portion of the cross frame part projects outwardly from its location of connection with the second side member, and wherein the means for adjusting is positioned outwardly of the location of connection of the lower frame part to the second side member.

7. An end support according to claim 6, further comprising a caster connected to the cross frame part outwardly of said means for adjusting, said caster being positioned to be elevated above the support surface when the second support foot is in said lower position and to be in contact with the support surface when the said second support foot is in its said upper position, so that when the second support foot is in its said upper position, the end support is supported for movement by said wheel and said caster.

8. An end support for an elongated outrigger beam which during use is supported on a building roof or the like, by a pair of such supports, spaced apart longitudinally of the beam and supporting such beam with an outboard end portion thereof extending outwardly from the side of the building, to provide an upper end support for a suspended staging, said end support comprising:

a frame having an upper portion connectable to the beam, and first and second support feet spaced apart from each other, laterally of the beam, with the first support foot being located on one side of the beam and the second support foot being located on the opposite side of the beam;

a wheel mounted on said frame between the support feet, for rotation about an axis which is parallel to the beam;

means for adjusting the relative vertical positions of the first and second support feet and a lower support contacting portion of the wheel, between a first position in which the first and second support feet are both on the support surface and the wheel is elevated above the support surface, and the system is fixed in position on the support surface, and a second position in which the wheel is down on the support surface and both support feet are spaced above the support surface, and the system is mobile on the wheel; and wherein said end support frame is generally in the shape of an A-frame, having an upper end apex portion connectable to the beam, a pair of downwardly diverging side members connectable at their upper ends to the apex portion, and a cross frame part interconnected between lower portions of said side members, wherein said lower frame part comprises a pair of spaced apart horizontal side members, and said wheel is positioned between said horizontal side members and is supported for rotation by means which extends between said horizontal side members.

9. An end support according to claim 8, wherein said apex portion is a tube adapted to telescopically receive the outrigger beam, and said apex portion includes means for releasably connecting the apex portion to the beam.

10. An end support according to claim 8, wherein the first and second side members are each a length of tubing.

11. An end support according to claim 10, wherein the cross frame part comprises a U-shaped tubing member, having a closed end, two sides and an open end, and wherein the closed end of said tubing member is secured to a lower portion of the first side member, and wherein a support member is interconnected between the sides of such U-shaped tubing member at its open end, and wherein the lower end of the second side member is connected to said support member, and wherein the means for adjusting is mounted on said support member.

12. An end support according to claim 11, wherein said wheel is positioned between the two sides of the U-shaped tubing member and is supported for rotation by means extending between said sides of the U-shaped member.

13. An end support according to claim 12, further including a caster connected to said mounting member outwardly of said means for adjusting, said caster being positioned to be elevated above the support surface when the second support foot is in said lower position and to be in contact with the support surface when the said second support foot is in its upper position, so that when the second support foot is in its said upper position, the end support is supported for movement by said wheel and said caster.

14. An end support for an elongated outrigger beam which during use is supported on a building roof or the like, by a pair of such supports, spaced apart longitudinally of the beam and supporting such beam with an outboard end portion thereof extending outwardly from the side of the building, to provide an upper end support for a suspended staging, said end support comprising:

a frame having an upper portion connectable to the beam, and first and second support feet spaced apart from each other, laterally of the beam, with the first support foot being on one side of the beam and the second support foot being located on the opposite side of the beam;

a wheel mounted on said frame between the support feet, for rotation about an axis which is parallel to the beam;

means for adjusting the relative vertical positions of the first and second support feet and a lower support contacting portion of the wheel, between a first position in which the first and second support feet are both on the support surface and the wheel is elevated above the support surface, and the system is fixed in position on the support surface, and a second position in which the wheel is down on the support surface and both support feet are spaced above the support surface, and the system is mobile on the wheel; and wherein said end support frame is generally in the shape of an A-frame, having an upper end apex portion connectable to the beam, a pair of downwardly diverging, first and second side members connectable at their upper ends to the apex portion, and a cross frame part interconnected between lower portions of said side members, and further comprising a diagonal brace means extending from a location of connection with said frame spaced below said apex portion upwardly to said beam, at a location spaced along said beam from said apex portion, said diagonal brace means including a tubular member at its upper end, and said apex portion being a tubular member, said tubular members being axially aligned and sized to telescopically receive the beam, and means for adjustably securing at least one of said tubular members to said beam.

15. A roof support for a suspended staging, comprising:

an elongated beam;

a pair of end supports for said beam, spaced apart longitudinally of the beam and in use supporting such beam with an outboard end portion thereof extending outwardly from the side of the building, to serve as an upper end support for a suspended staging which travels up and down along side of the building, each said end support comprising:

a frame having an upper portion connectable to the beam, and first and second support feet spaced apart from each other, laterally of the beam, with the first support foot being located on one side of the beam and the second support foot being located on the opposite side of the beam;

a wheel mounted on said frame below the beam and between the support feet, for rotation about an axis which is parallel to the beam;

means for adjusting the relative vertical positions of the first and second support feet and a lower support surface contacting portion of the wheel, between a first position in which the first and second support feet are both on the support surface and the wheel is elevated above the support surface, and the system is fixed in position on the support surface, and a second position in which the wheel is down on the support surface and both support feet are spaced above the support surface, and the system is mobile on the wheels;

wherein the means for adjusting comprises means for moving the second foot in position vertically relative to said frame, between a lower position in which said first and second support feet are both on the roof or other support surface and the wheel is elevated above the support surface, and an upper position in which the wheel is down on the support surface and both support feet are spaced above the support surface; and wherein each end support further comprises a small caster mounted on said frame proximate the second foot, said caster being positioned to be elevated above the support surface contacting portion of the wheel when the second support foot is in said lower position and to be in contact with the support surface when the said second support foot is in its said upper position, so that when the second support foot is in its said upper position, the end support is supported for movement by said wheel and said caster.

16. A support according to claim 15, wherein the means for adjusting comprises screw jack means interconnected between the frame and said second foot, including rotatable handle means rotatable in a first direction for moving the frame upwardly relative to the second foot and in the opposite direction for moving the frame downwardly in relation to the second foot.

17. A support according to claim 15, wherein the wheel on each end support is positioned on the frame of such end support to be in substantial vertical alignment with the center of gravity of the weight on said end support.

18. A support according to claim 15, in which each said end support frame is generally in the shape of an A-frame, having an upper end apex portion connectable to the beam, a pair of downwardly diverging, first and second side members connectable at their upper ends to the apex portion, and a cross frame part interconnected between lower portions of said side members.

19. A support according to claim 15, comprising a beam which is adjustable in length.

20. A support according to claim 19, wherein said beam includes a relatively small diameter portion which is telescopically received within a relatively large diameter portion, one of said portions having at least one sidewall opening therein and the other of said portions having a plurality of axially spaced apart sidewall openings, alignable with the opening in said first portion, and pin means for extending through the aligned openings for securing the two portions together.

21. A support according to claim 15, wherein one of the end supports is during use positioned adjacent the side of the building and the second end support is spaced inwardly of said first end support, said support further including counterweight means carried at a location between the two end supports but adjacent the second end support.

22. A roof support for a suspended staging, comprising:

an elongated beam;

a pair of end supports for said beam, spaced apart longitudinally of the beam and in use supporting such beam with an outboard end portion thereof extending outwardly from the side of the building, to serve as an upper end support for a suspended staging which travels up and down along side of the building, each said end support comprising:

a frame having an upper portion connectable to the beam, and first and second support feet spaced apart from each other, laterally of the beam, with the first support foot being located on one side of the beam and the second support foot being located on the opposite side of the beam;

a wheel mounted on said frame below the beam and between the support feet, for rotation about an axis which is parallel to the beam;

means for adjusting the relative vertical positions of the first and second support feet and a lower support contacting portion of the wheel, between a first position in which the first and second support feet are both on the support surface and the wheel is elevated above the support surface, and the system is fixed in position on the support surface, and a second position in which the wheel is down on the support surface and both support feet are spaced above the support surface, and the system is mobile on the wheels;

wherein each said end support frame is generally in the shape of an A-frame, having an upper end apex portion connectable to the beam, a pair of downwardly diverging, first and second side members connectable at their upper ends to the apex portion, and a cross frame part interconnected between lower portions of said side members; and wherein said cross frame part includes a first end portion connected to the first side member, at a location spaced above the first support foot, and a second end portion connectable to the second side member at a location spaced above the second support foot, wherein the first side member extends downwardly from its location of connection with the cross frame part and terminates at a lower end, and wherein said first support foot is connected to said lower end.

23. A support according to claim 22, wherein the second end portion of the cross frame part projects outwardly from its location of connection with the second side member, and wherein the means for adjusting is positioned outwardly of the location of connection of the lower frame part to the second side member.

24. A support according to claim 23, further comprising a caster connected to the cross frame part outwardly of said means for adjusting, said caster being positioned to be elevated above the support surface when the second support foot is in said lower position and to be in contact with the support surface when the said second support foot is in its said upper position, so that when the second support foot is in its said upper position, the end support is supported for movement by said wheel and said caster.

25. A roof support for a suspended staging, comprising:

an elongated beam;

a pair of end supports for said beam, spaced apart longitudinally of the beam and in use supporting such beam with an outboard end portion thereof extending outwardly from the side of the building, to serve as an upper end support for a suspended staging which travels up and down along side of the building, each said end support comprising:

a frame having an upper portion connectable to the beam, and first and second support feet spaced apart from each other, laterally of the beam, with the first support foot being located on one side of the beam and the second support foot being located on the opposite side of the beam;

a wheel mounted on said frame below the beam and between the support feet, for rotation about an axis which is parallel to the beam;

means for adjusting the relative vertical positions of the first and second support feet and a lower support surface contacting portion of the wheel, between a first position in which the first and second support feet are both on the support surface and the wheel is elevated above the support surface, and the sysem is fixed in position on the support surface, and a second position in which the wheel is down on the support surface and both support feet are spaced above the support surface, and the system is mobile on the wheels; and wherein each said end support frame is generally in the shape of an A-frame, having an upper end apex portion connectable to the beam, a pair of downwardly diverging side members connectable at their upper ends to the apex portion, and a cross frame part interconnected between lower portions of said side members, wherein said lower frame part comprises a pair of spaced apart horizonal side members, and said wheel is positioned between said horizontal side members and is supported for rotation by means which extends between said horizontal side members.

26. A support according to claim 25, wherein the apex portion of each frame is a tube adapted to telescopically receive the beam, and said apex portion includes means for releasably connecting the apex portion to the beam.

27. A support according to claim 25, wherein the first and second side members are each a length of tubing.

28. A support according to claim 27, wherein the cross frame part of each end support comprises a U-shaped tubing member, having a closed end, two sides and an open end, and wherein the closed end of said tubing is secured to a lower portion of the first side member, and wherein a support member is interconnected between the sides of such U-shaped tubing member at its open end, and wherein the lower end of the second side member is connected to said support member, and wherein the means for adjusting is mounted on said support member.

29. A support according to claim 28, wherein the wheel of each end support is positioned between the two sides of the U-shaped tubing member and is supported for rotation by means extending between said sides of the U-shaped member.

30. A support according to claim 29, further including a caster connected to said mounting member outwardly of said means for adjusting, said caster being positioned to be elevated above the support surface when the second support foot is in said lower position and to be in contact with the support surface when said second support foot is in its upper position, so that when the second support foot is in its said upper position, the end support is supported for movement by said wheel and said caster.

31. A roof support for a suspended staging, comprising:

an elongated beam;

a pair of end supports for said beam, spaced apart longitudinally of the beam and in use supporting such beam with an outboard end portion thereof extending outwardly from the side of the building, to serve as an upper end support for a suspended staging which travels up and down along side of the building, each said end support comprising:

a frame having an upper portion connectable to the beam, and first and second support feet spaced apart from each other, laterally of the beam, with the first support foot being located on one side of the beam and the second support foot being located on the opposite side of the beam;

a wheel mounted on said frame below the beam and between the support feet, for rotation about an axis which is parallel to the beam;

means for adjusting the relative vertical positions of the first and second support feet and a lower support surface contacting portion of the wheel, between a first position in which the first and second support feet are both on the support surface and the wheel is elevated above the support surface, and the system is fixed in position on the support surface, and a second position in which the wheel is down on the support surface and both support feet are spaced above the support surface, and the system is mobile on the wheels; and wherein each said end support frame is generally in the shape of an A-frame, having an upper end apex portion connectable to the beam, a pair of downwardly diverging, first and second side members connectable at their upper ends to the apex portion, and a cross frame part interconnected between lower portions of said side members, and further comprising a diagonal brace means extending from a location of connection with said frame spaced below said apex portion upwardly to said beam, at a location spaced along said beam from said apex portion, said diagonal brace means including a tubular member at its upper end, and said apex portion being a tubular member, said tubular members being axially aligned and sized to telescopically receive the beam, and means for adjustably securing at least one of said tubular members to said beam.

32. A roof support for a suspended staging, comprising:

an elongated beam;

a pair of end supports for said beam, spaced apart longitudinally of the beam and in use supporting such beam with an outboard end portion thereof extending outwardly from the side of the building, to serve as an upper end support for a suspended staging which travels up and down along side of the building, each said end support comprising:

a frame having an upper portion connectable to the beam, and first and second support feet spaced apart from each other, laterally of the beam, with the first support foot being located on one side of the beam and the second support foot being located on the opposite side of the beam;

a wheel mounted on said frame below the beam and between the support feet, for rotation about an axis which is parallel to the beam;

means for adjusting the relative vertical positions of the first and second support feet and a lower support surface contacting portion of the wheel, between a first position in which the first and second support feet are both on the support surface and the wheel is elevated above the support surface, and the system is fixed in position on the support surface, and a second position in which the wheel is down on the support surface and both support feet are spaced above the support surface, and the system is mobile on the wheels;

wherein one of the end supports is during use positioned adjacent the side of the building and the second end support is spaced inwardly of said first end support, said support further including counterweight means carried at a location between the two end supports but adjacent the second end support; and wherein said counterweight means comprises a support bar extending laterally of the beam, and including outwardly projecting end portions, one on each side of the beam, and weight elements secured to said support bar.

33. A support according to claim 32, wherein said weights have openings therethrough for receiving a projecting end portion of the support bar.

* * * * *

UNITED STATES PATENT AND TRADEMARK OFFICE

CERTIFICATE OF CORRECTION

PATENT NO. : 4,496,027

DATED : January 29, 1985

INVENTOR(S) : Harry S. Fisher

It is certified that error appears in the above-identified patent and that said Letters Patent are hereby corrected as shown below:

Column 2, line 45, "plate" should be --foot--.

Column 3, line 45, "outriggers" should be --outrigger 16--.

Column 3, line 46, "22" should be deleted.

Column 4, line 42, "is" should be --the--.

Signed and Sealed this

*Sixteenth* Day of *July 1985*

[SEAL]

*Attest:*

DONALD J. QUIGG

*Attesting Officer* *Acting Commissioner of Patents and Trademarks*